US005433026A

United States Patent [19]

McDermott et al.

[11] Patent Number: 5,433,026

[45] Date of Patent: Jul. 18, 1995

[54] LOW-PROFILE MESSAGE BOARD WITH SIDE-MOUNTED MOTOR AND MOMENT ARM

[76] Inventors: Vernon C. McDermott; Vernon C. McDermott, Jr., both of 60-41 83rd St., Elmhurst, N.Y. 11373

[21] Appl. No.: 69,545

[22] Filed: Jun. 1, 1993

[51] Int. Cl.[6] ..... G09F 21/04

[52] U.S. Cl. ..... 40/592; 40/610; 248/293

[58] Field of Search ..... 40/592, 606, 610; 248/291, 293

[56] References Cited

U.S. PATENT DOCUMENTS

| | | | |
|---|---|---|---|
| 3,295,242 | 1/1967 | McGregor | 40/592 |
| 3,318,031 | 5/1967 | Whaley et al. | 40/592 |
| 3,761,890 | 9/1973 | Fritts et al. | 40/592 |
| 3,952,981 | 4/1976 | Acker | 248/291 |
| 4,152,854 | 5/1979 | Berry, Jr. et al. | 40/610 |
| 4,259,660 | 3/1981 | Oliver | 40/592 |
| 4,306,276 | 12/1981 | Dick | 362/66 |
| 4,609,133 | 9/1986 | Anderson | 40/592 |
| 4,662,095 | 5/1987 | Higgins | 40/592 |
| 4,707,014 | 11/1987 | Rich | 296/180.1 |
| 4,787,665 | 11/1988 | Rich | 296/180.1 |
| 4,805,324 | 2/1989 | Anderson | 40/592 |
| 4,835,515 | 5/1989 | McDermott et al. | 340/472 |
| 4,960,256 | 10/1990 | Chihara et al. | 248/291 |

*Primary Examiner*—Richard A. Bertsch
*Assistant Examiner*—Howard R. Richman
*Attorney, Agent, or Firm*—Morgan & Finnegan

[57] ABSTRACT

A vehicularly-mountable message board that can be automatically maneuvered between an upright message-displaying position and a retracted position by utilizing a side-mounted actuating motor and side-mounted moment arm. The vehicularly-mountable message board achieves the benefits of high-profile visibility of the message board in the upright position without obstruction by the actuating motor or the moment arm, while at the same time achieving the benefits of the location of the side-mounted actuating motor and side-mounted moment arm to achieve a low profile for the message board in the retracted configuration. The side-mounted actuating motor and side mounted moment arm significantly reduce the total surface area on the subject vehicle's roof required for mounting an automatically retractable message board, greatly aids in the manufacturing and vehicular installation of the automatically retractable message board and facilitates upgrading manually retractable message boards to automatically retractable message boards.

13 Claims, 4 Drawing Sheets

LOW-PROFILE MESSAGE BOARD WITH SIDE-MOUNTED MOTOR AND MOMENT ARM

BACKGROUND OF THE INVENTION

1. Field of the Invention

The present invention relates to vehicularly-mountable message boards.

2. Description of the Related Art

When there is an automobile accident, or when construction crews are working on streets and highways, warning signs on the roofs of emergency or construction vehicles are considered a generally accepted method for reducing accidents involving oncoming traffic. Unfortunately, these roof-mounted warning signs, when mounted for maximum visibility, create unwanted wind resistance and clearance hazards for the vehicles when the vehicles are in transit.

In order to minimize the wind resistance caused by these roof-mounted warning signs in addition to preventing damage to the roof of the vehicle from low clearance obstacles, devices have been invented to alternate these roof-mounted warning signs between (1) high-visibility, high wind resistance configurations for when the vehicle is not moving, and (2) low-visibility, low-wind resistance, and generally lower profile configurations for when the vehicle is in transit.

In the past, however, these goals were achieved only through complicated designs that have proven difficult and expensive to manufacture, and which fail to achieve the full potential for maximizing high-profile visibility while maintaining low-profile unobtrusiveness and minimizing manufacturing costs.

For example, U.S. Pat. Nos. 3,761,890, 4,152,854, and 4,259,660 disclose retractable or collapsible warning signs which are mounted to the roof of an automobile. However, these patents do not suggest or teach the benefits that a side-mounted actuating motor with side mounted moment arm can provide in achieving the seemingly diametrically opposed goals of high visibility and a low-profile configuration.

In particular, U.S. Pat. No. 4,152,854 poses clearance problems since it remains notably high above the roof of the vehicle even in the fully retracted configuration. Other devices have utilized a configuration where the motor is located beneath the warning sign when in its retracted position. Devices that utilize an actuator located in the center of the warning sign pose one of two problems. If the actuating motor and moment arm lie underneath the warning sign in the fully retracted configuration, then clearance problems are present since the total clearance of the retraced warning sign must accommodate for the height of the actuating motor and moment arm which are mounted directly beneath the sign.

Other patented devices, such as the sign disclosed in U.S. Pat. No. 4,259,660, sought to alleviate this clearance problem but, unfortunately, created other difficulties in so doing. For example, in the device disclosed in the 4,259,660 patent, the activating motor and the moment arm are on the opposite side of the axis of rotation of the warning sign when the warning sign is in the fully retracted configuration; thus, this automatically retractable warning sign requires a significant and potentially prohibitive length of the vehicle's roof. Moreover, the use of a centrally-located actuation motor and moment arm, as disclosed in the 4,259,660 patent, interferes with the orthogonal visibility of the warning sign.

Still other patented devices, such as the device disclosed in U.S. Pat. No. 3,761,890, created the disadvantages associated with complex drive mechanisms. In particular, the 3,761,890 patent discloses a device which utilizes a complex dual-drive mechanism with two moment arms to rotate an apparatus from a display position to a retracted position. Such complexity is particularly disadvantageous in view of the difficulty and expense associated with manufacturing such a system.

OBJECTS OF THE INVENTION

It is an object of the instant invention, therefore, to provide a message board which is configured to greatly enhance and facilitate cost-effective manufacture.

It is also an object of the instant invention to provide a message board having an ultra-low profile in its retracted position.

It is also an object of the instant invention to provide a message board having an obstructionless orthogonal field of view when in its upright message-displaying position.

It is also an object of the instant invention to provide a vehicularly-mountable message board which occupies a minimum amount of surface area on the subject vehicle while simultaneously maximizing the amount of usable surface area on the message board.

It is also an object of the instant invention to provide a message board to achieve all of the aforementioned objects while providing a fully-extendable message board having maximum visibility.

FEATURES AND ADVANTAGES OF THE PRESENT INVENTION

The present invention enables a message board to be extended to a high-visibility configuration without any orthogonal obstruction of the message board by the actuating motor moment arm. When the message board is lowered into a retracted configuration, the message board is able to retract completely since the actuating motor and the moment arm is mounted off the side of the message board. Thus, the message board, in its retracted position, rests substantially flat atop the roof of the vehicle. Furthermore, since the actuating motor and the moment arm are located to the side of the message board (in its retracted position) the required mounting area (on the vehicle) is reduced simply to a narrow rectangular area the length of which extends across the width of the vehicle's roof. This greatly facilitates the placement of other equipment or warning devices on the roof of the vehicle such as rotating beacons, and other light bars since a minimum of the length of the vehicle's roof is reserved for the mounted retractable message board. In addition, such a configuration also greatly facilitates the manufacture of the unit during production since the actuating motor and the moment arm can be quickly and easily attached to the side of a standard message board mounted in a frame. Moreover, manually rotatable message boards can be quickly and easily upgraded to automatically retractable message boards simply by attaching the actuating motor and moment arm to the side of the manually rotatable message board. Thus, the present invention achieves all of the aforementioned objectives while also significantly reducing the complexity and cost of manufacturing a message board of this type. Furthermore, the instant invention reduces the complexity and cost of converting previously installed manually retractable message boards to automatically retractable message boards.

The foregoing and other objects, features and advantages of the invention as well as presently preferred embodiments will become more apparent from a reading of the following description in connection with the accompanying drawings.

SUMMARY OF THE INVENTION

The present invention is directed to a vehicularly-mountable message system having (1) pivotable means for displaying a message, the pivotable means comprising a display side and a mounting side, the pivotable means being pivotable between an upright message-displaying position and a retracted position, the retracted position being characterized in that the pivotable means lies substantially flat on the vehicle; (2) means for securing the pivotable means to the vehicle, the means for securing comprising at least one pivot; and (3) means for rotating the pivotable means about the at least one pivot, the means for rotating comprising a motor, a drive shaft, and a single moment arm for supplying all of the necessary torque to rotate the message board, the moment arm being directly and rotatably secured at one end to the mounting side of the pivotable means.

In addition, the present invention is also directed to a process for manufacturing a vehicularly-mountable message board system including (1) constructing a displayable and retractable message board having a mounting side and a display side; (2) constructing a frame for supporting and protecting the message board; (3) locating the message board at least partially within the frame when in a retracted position; and (4) attaching a drive mechanism to the mounting side of the message board, wherein the attachment of the drive mechanism and the location of the message board create an unobstructed orthogonal field of view of the display side of the message board when in a display position.

DETAILED DESCRIPTION OF THE PREFERRED EMBODIMENTS OF THE PRESENT INVENTION

Referring now to the accompanying drawings, the present invention is characterized generally by a pivotable means for displaying a message, a means for securing the pivotable means to a vehicle and a drive mechanism for rotating the pivotable means from a retracted position to a display position. Each of these elements will now be described in greater detail below.

Figure 1:
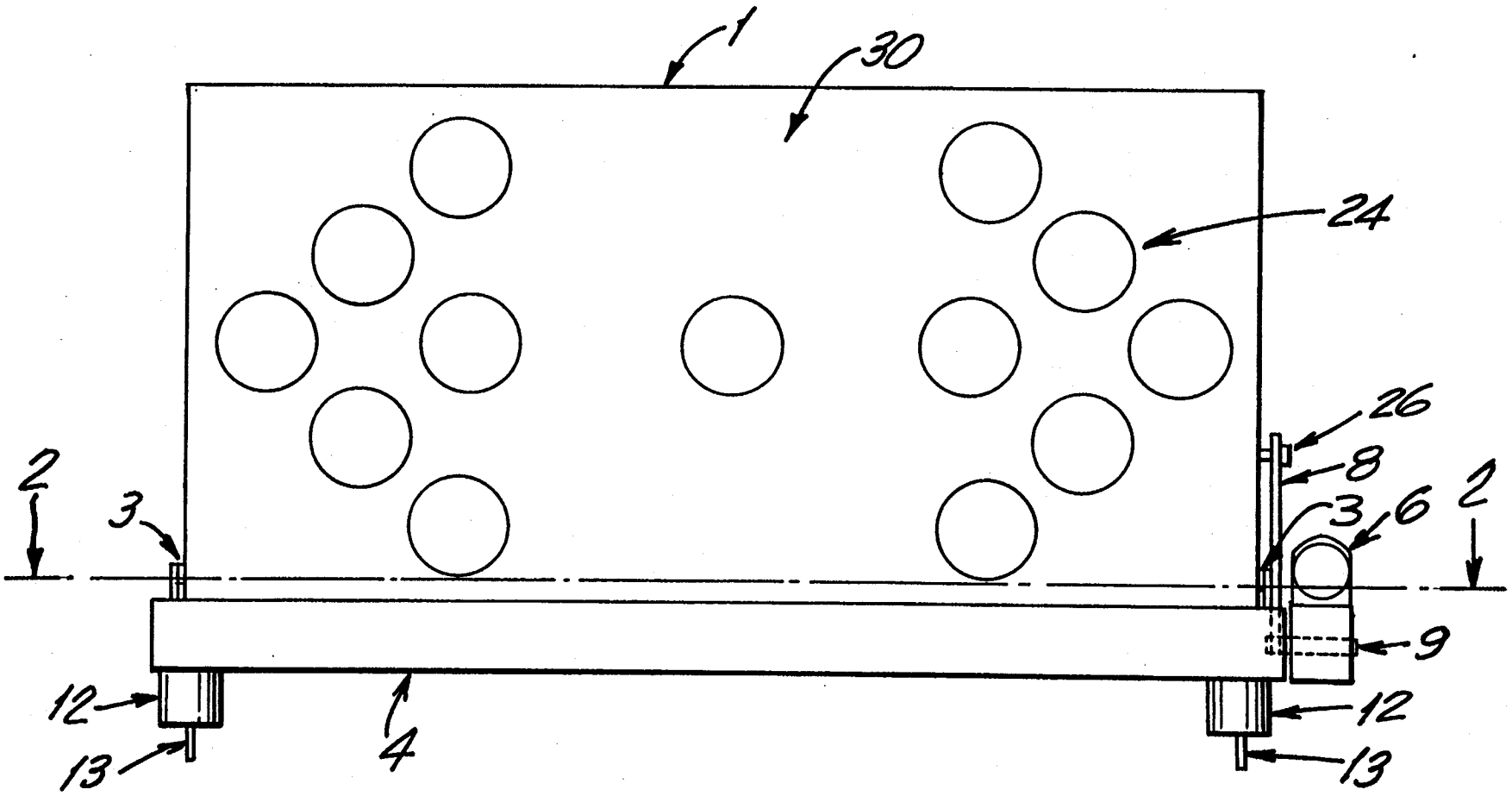
FIG. 1 is a front view of the message system of the present invention in its display position.
Figure 2:
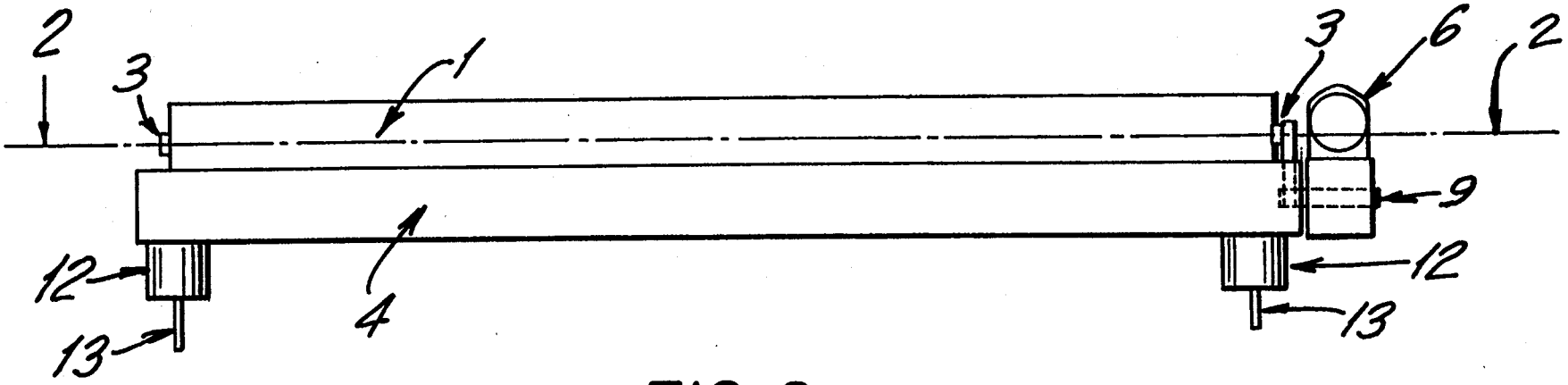
FIG. 2 is a front view of the message system of the present invention in its retracted position.
Figure 3:
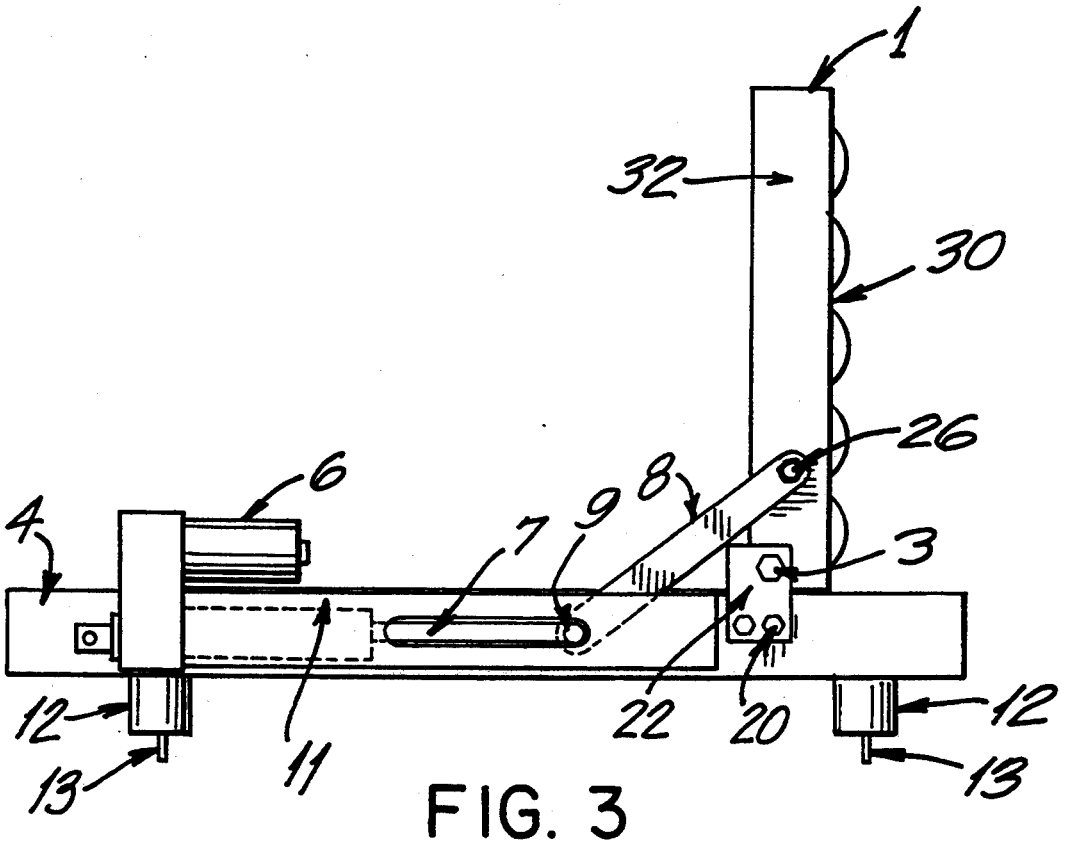
FIG. 3 is a side view of the message system of the present invention in its display position.

Referring initially to FIG. 1, the instant invention is shown in its fully upright message-displaying position in which a message board 1 is presented to oncoming traffic with high visibility. As best seen in FIGS. 1 and 3, message board 1 has a display side 30 and a mounting side 32. In general, the pivotable means for displaying a message comprises message board 1 having warning lights 24. Preferably, warning lights 24 are sealed beam warning lights having high-intensity light bulbs. In the alternative, however, other warning lights may be utilized. Message board I is configured to pivot about the horizontal axis 2 at the bottom of the message board around bolts 3. Bolts 3 serve as a pivot to facilitate rotation of the message board 1 from a retracted position, as shown in FIG. 2, to an upright message-displaying position, as shown in FIG. 1. Although two bolts 3 are used to rotate message board 1, other forms of pivots may be used in lieu of bolts 3.

Thus, FIG. 2 shows, generally, the instant invention in a retracted configuration in which the message board 1 lies substantially flat on the vehicle to which it is mounted so as to provide minimum wind resistance when the vehicle is in motion.

With reference to FIG. 3, the drive mechanism for rotating the message board 1 include an actuating motor 6, a drive shaft 7 and a moment arm 8. Moment arm 8 is connected to the mounting side 32 of message board 1 via bolt 26. Although other motors and drive shafts may be used, actuating motor 6 and drive shaft 7 are preferably the Electrak 10 model, available from Warner Electric, South Beloit, Ill.

With continuing reference to FIG. 3, the instant invention is shown in its upright message-displaying position in which the actuating motor 6 is shown with the motor drive shaft 7 fully pushed forward. As a result of the position of drive shaft 7, moment arm 8 is also shown in a position in which it is fully pushed forward. As shown in FIG. 3, drive shaft 7 is housed within a protective outer sleeve 11. Protective outer sleeve 11 has a channel 10 which is configured to receive a perpendicularly-mounted slidable cylinder 9. Slidable cylinder 9 serves to connect drive shaft 7 with moment arm 8. As is evident from FIGS. 1 and 3, the drive mechanism of the instant invention does not impede orthogonal visibility of the display side 30 of message board 1, particularly because the drive mechanism is mounted to the side of message board 1.

Figure 4:
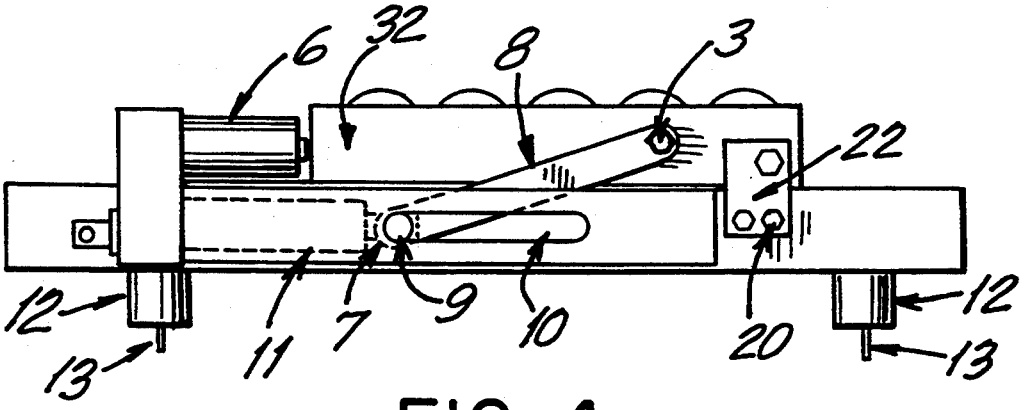
FIG. 4 is a side view of the message system of the present invention in its retracted position.

FIG. 4, on the other hand, depicts the instant invention in its ultra-low profile retracted position. In particular, drive shaft 7 is shown in a position in which it is fully pulled back. As a result, moment arm 8 is also shown in a position in which it is fully pulled back. As also shown in FIG. 4, the drive mechanism of the instant invention faces mounting side 32, but not display side 30, of message board I when in its retracted position. This positioning of the drive mechanism serves to create the obstructionless orthogonal visibility of the message board 1 when in its upright message-displaying position.

Figure 5:
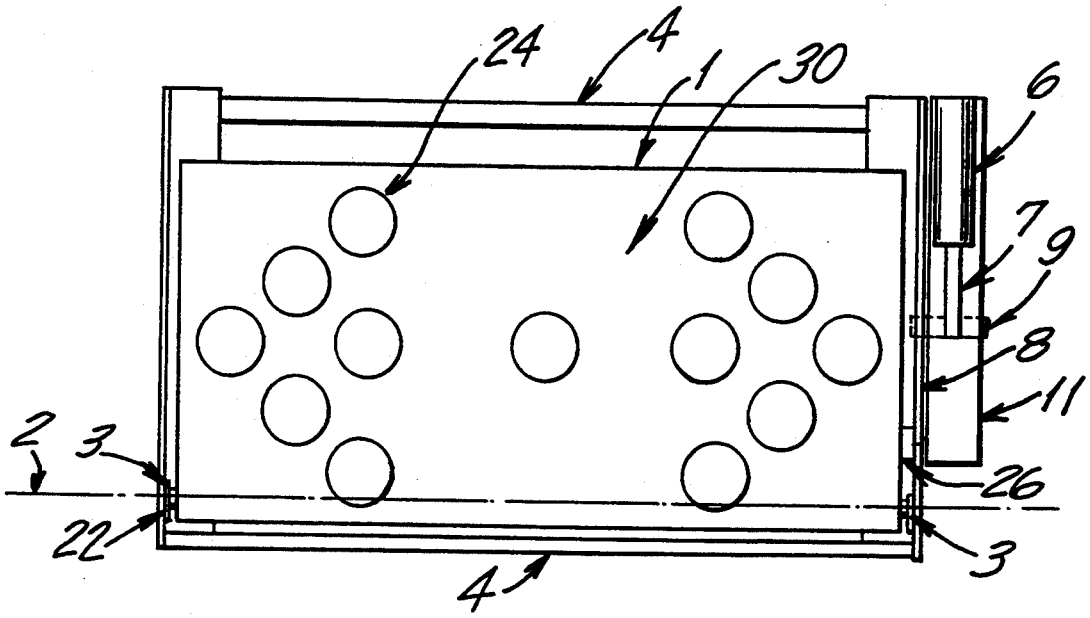
FIG. 5 is a top view of the message system of the present invention in its retracted position.

As shown in FIGS. 3 and 4, bolts 3 in conjunction with bolts 20 serve to secure the message board 1 to its frame 4 via plate 22. As shown in FIG. 5, frame 4, which is preferably rectangular in shape, may be mounted to the roof of a vehicle (not shown) using vehicle mounting screws 13 which are surrounded by rubber bumpers 12. Although not shown, frame 4 has a channel track, similar in length, width and shape to channel 10, to receive at least a portion of slidable cylinder 9. Thus, slidable cylinder 9, while serving to connect drive shaft 7 with moment arm 8, extends through frame 4 and outer sleeve 11. Although slidable cylinder 9 and drive shaft 7 are preferably cylindrical in shape, other suitable geometric shapes may also be used.

In use, message board 1 is rotated as the actuating motor 6 is activated so as to actuate drive shaft 7 to move moment arm 8. As moment arm 8 is moved, it rotates about bolt 26 thereby rotating message board 1. In particular, as actuating motor 6 pushes drive shaft 7 forward, the message board 1 is pushed by slidable cylinder 9, moment arm 8 and bolt 26 so as to rotate board 1 about bolts 3 until board 1 ultimately reaches its upright message-displaying position as shown in FIGS. 1 and 3. Moreover, as actuating motor 6 pulls drive shaft 7 back toward motor 6, moment arm 8 and bolt 26 pull message board 1 so as to rotate board 1 about bolts 3 until board 1 ultimately reaches its retracted position as shown in FIGS. 2, 4 and 5.

With continuing reference to the accompanying drawings, the preferred method of manufacturing the aforementioned message system will now be described. In the preferred embodiment of the invention, the message board 1 consists of four pieces of aluminum channel cut at 45 degrees at each end interconnecting with each other forming 90 degree angles that define a rectangular prism. Two sheets of aluminum are laid flat on each of the two exposed sides of the prism and fixed to the channels defining the prism with screws. Holes are cut in one of the sheets so that sealed beam warning lights 24 can be recessed into and permanently mounted to the aluminum sheet. This message board 1 is then attached by two bolts 3 to a rectangular aluminum frame 4 creating an axis of rotation 2 about which the message board 1 can rotate between the extended and retracted configurations. In the alternative, a pre-made manually operable message board and frame may be used in conjunction with the instant invention. A channel (not shown), similar to channel 10 of the drive mechanism, is then preferably bored into a side wall of the frame 4. In addition, moment arm 8 is attached to the mounting side 32 of the message board 1 via bolt 26 or by other convenient means.

To assemble the drive mechanism, a preferably premade motor 6 and drive shaft 7 (from Warner Electric as previously described) is utilized. In the alternative, the motor 6 and drive shaft 7 may be manufactured by standard manufacturing techniques. An aluminum outer sleeve is then placed around drive shaft 7. Outer sleeve 11 preferably has a bored channel for receiving slidable cylinder 9.

Once the aforementioned message board and frame are constructed (or purchased), the aforementioned drive mechanism is simply attached to the frame 4 (preferably welded) and slidable cylinder 9 is also inserted within a receiving hole (not shown) in drive shaft 7 and within a receiving hole (not shown) in moment arm 9. Lock washers (not shown) are attached at both ends of the cylinder 9 to maintain the cylinder 9 within these respective receiving holes of the drive shaft 7 and moment arm 9.

The rectangular aluminum frame is then mounted to the roof a vehicle using four vehicle mounting screws 13 that insert through the center of four rubber bumpers 12 into the roof of the vehicle.

The scope of the present invention should be determined not by the scope of the aforementioned detailed description of the preferred embodiments, but by the appended claims and their legal equivalents.

What is claimed is:

1. A vehicularly-mountable message system, comprising:

pivotable means for displaying a message, said pivotable means comprising a display side and a mounting side, said pivotable means being pivotable between an upright message-displaying position and a retracted position, said retracted position being characterized in that said pivotable means lies substantially flat on said vehicle;

means for securing said pivotable means to said vehicle, said means for securing comprising at least one pivot; and means for rotating said pivotable means about said at least one pivot, said means for rotating comprising a motor, a drive shaft, and single moment arm means, said single moment arm means for supplying all of the necessary torque to rotate said pivotable means, wherein said means for rotating is positioned entirely outside an orthogonal field of view of said display side of said pivotable means when in said upright message-displaying position.

2. The vehicularly-mountable message system of claim 1 wherein said means for rotating is configured to pull said pivotable means into said retracted position.

3. The vehicularly-mountable message system of claim 1 wherein said means for rotating is configured to push said pivotable means into said upright message-displaying position from said retracted position.

4. The vehicularly-mountable message system of claim 1, further comprising a frame, said frame being mountable to said vehicle between said pivotable means and said vehicle.

5. The vehicularly-mountable message system of claim 4 wherein said frame defines a channel means for sliding at least a portion of said means for rotating.

6. The vehicularly-mountable message system of claim 5 wherein said means for rotating further comprises a slidable cylinder, said slidable cylinder being slidably received in said channel means.

7. The vehicularly-mountable message system of claim 1, wherein said means for securing further comprises a frame for fully supporting said message system.

8. The vehicularly-mountable message system of claim 7 wherein said pivotable means lies at least partially within said frame when in said retracted position.

9. The vehicularly-mountable message system of claim 7 wherein said motor is disposed on a base, wherein at least a portion of said motor faces said mounting side of said pivotable means when said pivotable means is in said retracted position.

10. A process for manufacturing a vehicularly-mountable message board system, comprising:

constructing a displayable and retractable message board having a mounting side and a display side;

constructing a frame for supporting and protecting said message board;

locating said message board at least partially within said frame when in a retracted position; and attaching to said mounting side of said message board a drive mechanism for supplying all of the necessary torque to rotate said message board, wherein the attachment of said drive mechanism and the location of said message board create an unobstructed orthogonal field of view of said display side of said message board when in a display position, and wherein said drive mechanism has only one moment arm for rotating said message board.

11. The process of manufacturing the vehicularly-mountable message board system of claim 10, further comprising:

constructing a drive mechanism utilizing a motor, a drive shaft and a moment arm.

12. The process of manufacturing the vehicularly-mountable message board of claim 11 further comprising:

constructing a housing to at least partially encapsulate at least a portion of said drive mechanism.

13. A vehicularly-mountable message board as manufactured by the process of claim 10.

* * * * *